United States Patent [19]

Rombach et al.

[11] 4,108,409

[45] Aug. 22, 1978

[54] GOLF BAG ACCESSORY

[76] Inventors: Joseph Xavier Rombach, 5364 Plover La., Cincinnati, Ohio 45238; James Hubert Lambert, 3705 Susanna Dr., Cincinnati, Ohio 45239

[21] Appl. No.: 787,546

[22] Filed: Apr. 14, 1977

[51] Int. Cl.[2] ..... A63B 55/00

[52] U.S. Cl. ..... 248/96; 150/1.5 B; 248/156

[58] Field of Search ..... 248/96, 156; 150/1.5 B

[56] References Cited

U.S. PATENT DOCUMENTS

| | | | |
|---|---|---|---|
| 1,291,359 | 1/1919 | Babcock | 248/96 |
| 1,810,903 | 6/1931 | Campbell | 248/96 |
| 1,978,230 | 10/1934 | Schutes | 248/96 X |
| 1,978,242 | 10/1934 | Zack | 248/96 X |
| 2,475,041 | 7/1949 | Mattson | 248/156 |
| 2,600,713 | 6/1952 | Wells | 248/96 |
| 3,075,733 | 1/1963 | Kimmel | 248/96 |
| 3,191,900 | 6/1965 | Cayot | 248/96 |
| 3,467,033 | 9/1969 | Sienkiewicz et al. | 248/156 X |
| 3,570,795 | 3/1971 | Benzel | 248/96 |

FOREIGN PATENT DOCUMENTS

| | | | |
|---|---|---|---|
| 980,734 | 12/1975 | Canada | 150/1.5 B |

*Primary Examiner*—Rodney H. Bonck

[57] ABSTRACT

Golf bag accessory for holding a golf bag, containing golf clubs, in an unattended, fixed, generally upright position on the golf course while golfer is engaged in playing the sport, thus precluding the necessity of the golfer having to stoop or bend over to deposit or pick up the golf bag from the ground.

10 Claims, 3 Drawing Figures

GOLF BAG ACCESSORY

BACKGROUND OF THE INVENTION

1. Field of the Invention

This invention relates to a golf bag accessory.

2. Description of the Prior Art

Many golfers utilize mechanized golf carts or hand drawn carts for transporting golf club-containing golf bags across the course playing field. Other golfers utilize caddies for transporting the golf bags. Many golfers, however, carry the loaded golf bags themselves. Such a golfer deposits the bag on the ground each time a stroke is to be taken with an appropriate club. This method requires a substantial amount of bending and stooping since, during the course of a regular game, the bag may have to be laid down and picked up in excess of two hundred times. Such bending and stooping may be particularly oppressive to golfers of advanced ages.

DETAILED DESCRIPTION OF THE INVENTION

Figure 1:
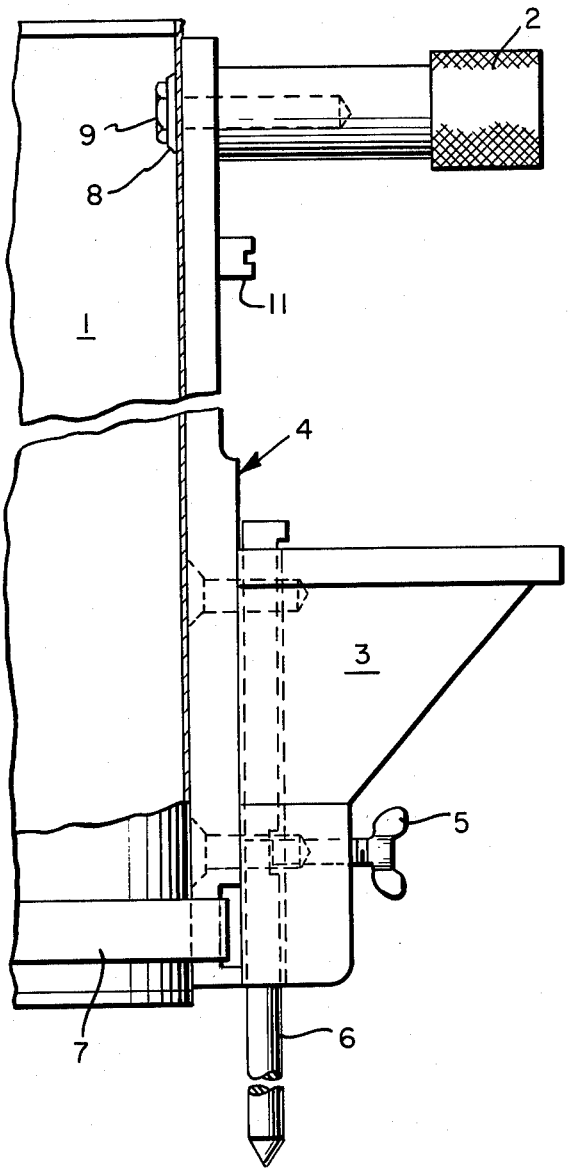
FIG. 1 shows a cross-sectional view of the golf bag holding device of this invention.
Figure 2:
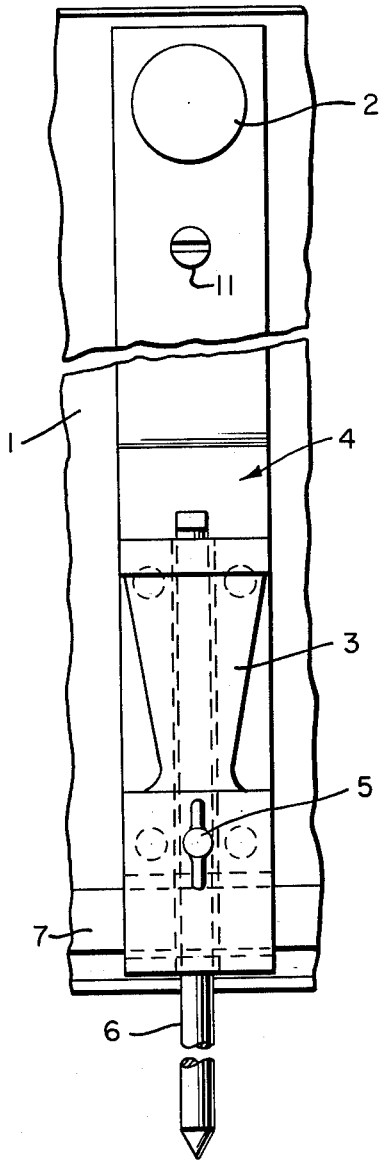
FIG. 2 shows another cross-sectional view of the invention, at a right angle to the first view.
Figure 3:
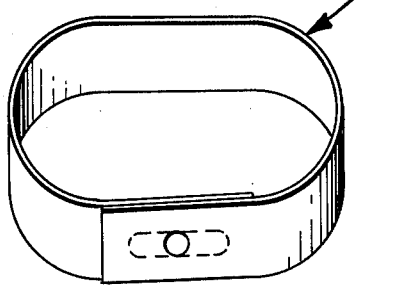
FIG. 3 shows an expansion band which may be inserted into the golf bag and used in conjunction with the invention.

This invention relates to a golf bag accessory which provides a convenience for golfers who do not employ a caddie or a mechanized or manually drawn golf cart for conveying their golf bags across a golf course while playing golf. More specifically, this invention relates to a golf bag accessory which holds the golf bag in an unattended, fixed, generally upright position while the golfer is engaged in the use of a particular club to propel the golf ball across the course. The invention is especially useful for golfers who are elderly or who, for one reason or another, wish to avoid bending over or stooping to deposit on or pick up from the ground a loaded golf bag. In summary, the invention resides in a device which may be temporarily or permanently affixed to the golf bag, which device includes a retractable/extendible shaft which may be forced into the ground by application of suitable pressure to an appropriate part of the device. The substance of the invention can readily be understood from the drawings which are part of this specification. In FIGS. 1 and 2 the golf bag is designated as 1. Attached to the bag is a rigid bag side strip 4 of appropriate dimensions, for example, one inch wide and of approximately the same or slightly lesser length than the height of the golf bag. At one end of the side strip is a suitable hole which may be employed as a template to puncture, cut or drill a corresponding hole in the golf bag, near the top. This end of the side strip is affixed to the bag by means of a grip handle 2 having a suitable female threaded aperture into which is inserted, from the inside of the golf bag through the aforesaid hole, a suitable corresponding male threaded screw or bolt 9. A suitable handle washer 9 may be used with the screw or bolt to ensure retention of the head of the screw or bolt inside the golf bag. As shown in FIG. 1, the grip handle includes a knurled end which may assist in holding the grip handle during the tightening of screw or bolt 9. The other end of the side strip 4 may be held to the bottom of the golf bag by a suitable flexible buckle strap or elastic band material 7. As shown in FIGS. 1 and 2, this end of the side strip may include a notched or indented region adapted to accept and hold in position the strap or band. In the event that the golf bag is too flexible to provide satisfactory tightening of the strap or band, a suitable rigid or semi-rigid expansion band 10 may be inserted into the bag and positioned appropriately at or near the bottom to maintain bag ridigity when the strap or band is tightened around the outside of the bag. Affixed to the side strip, on the opposite side to that which is adjacent to the lower portion of the golf bag, is press step 3. In the embodiment reflected in FIGS. 1 and 2, the press step is held to the side strip by means of four screws which are countersunk into the side strip. As shown in FIG. 1, the side strip is of greater thickness in the region whereat the press step is affixed to permit countersinking of the screws from the opposite side of the side strip. Inserted into a suitable longitudinal aperture in the press strip is a retractable/extendible holding rod 6 which is of suitable dimensions and shape that it can be forced into the ground, by application of appropriate pressure, for example, by pressing with the foot of the golfer, when it is held in a fixed extended position in the longitudinal aperture of the press step. As shown in FIGS. 1 and 2, the holding rod is extended below the end of the press step and held in such position by means of lock wing screw 5. To facilitate rigid fixing of the rod in the aperture, it may be suitably notched or indented, as shown in FIG. 1, to accept the end of the lock wing screw. The lock wing screw is suitably threaded into a female threaded aperture, in the press step, at a right angle to and so as to intersect the longitudinal aperture in the press step. As shown in FIGS. 1 and 2, in order to prevent inadvertent removal of the holding rod from the longitudinal aperture in the press step, a stop pin 11 may be suitably installed near the upper end of the bag side strip and the holding rod may have a suitable head of wider dimension than the diameter of the longitudinal aperture. Also as shown in these figures, the bottom or lower end of the holding rod is suitably pointed to facilitate easy penetration into the ground when force is applied to the press step as described above. In the embodiment represented by FIGS. 1 and 2, the longitudinal aperture in the press step is U-shaped, rather than entirely circular, so that the holding rod can be forced against the bag side strip by tightening of the lock wing screw. However, as depicted in these figures, the lock wing screw has not been tightened sufficiently to force the holding rod against the bag side strip.

Although the above description of the drawings suitably characterizes the invention to one of ordinary skill in the art, the following additional details are provided. The materials of construction for the invention golf bag accessory can vary widely. In general, rigid materials, of either a metallic or polymeric nature, are used. Although appropriate steels can readily be machined to provide parts which are useful in the invention device, polymeric or plastic materials also are useful, particularly if the parts can be feasibly fabricated by means of molding or extrusion techniques. Useful polymers include the rigid high impact polyamides, polycarbonates, polyacetals, polyolefins, acrylonitrile/butadiene/styrene polymers, and the like. Naturally, the suitable flexible buckle strap or elastic band material can be produced from any material, of either natural or synthetic origin, which is appropriate to the functionality of this part; for example, a leather or nylon strap having a metal buckle to effect tightening around the golf bag can be employed.

Because of its simplicity the invention device can be retained permanently or semi-permanently on the golf bag after installation or it can be conveniently attached and removed each time the golf bag is used to play golf. Once attached, especially for safety reasons, the retractable/extendible holding rod is held in the unextended or retracted position, by applying appropriate pressure thereagainst by means of the lock wing screw, until it becomes necessary to use the invention device for its intended purpose. When such occasion arises, the lock wing screw is loosened and the rod is extended to the desired position. If adequate clearance has been provided between the rod and the longitudinal aperture in the press step, the rod will gravitationally extend itself to its maximum possible length, in which position it can be fixed by tightening the lock wing screw. Once locked in position, pressure can be applied to the press step, for example, the golfer can push with his or her foot, to drive the holding rod into the ground. Once the holding rod is firmly implanted in the ground, the golf bag will be retained in a position substantially parallel to the direction of travel of the holding rod into the ground. Thus, on a level surface the holding rod can be driven into the ground in a direction substantially perpendicular to ground level and the golf bag will be maintained in a substantially vertical direction. On the other hand, on a sloped ground surface the holding rod can be driven into the ground at an angle so as to maintain the golf bag in a substantially vertical position. Angular positioning of the holding rod in the ground can also be employed to maintain the position of the golf bag in a non-vertical position, for example, to facilitate removal of a golf club from the bag.

When it is desirable to pick up the golf bag, while withdrawing the holding rod from the ground, such can be achieved by firmly grasping grip handle 2 and pulling in a direction generally opposite to that used to force the holding rod into the ground.

In reading the above description, one of ordinary skill in the art will readily appreciate the full significance of the invention, and additional embodiments thereof, not necessarily described above but fully within the spirit and scope of the invention, will become apparent and will be obvious therefrom. The following claims, which are hereby incorporated by reference, represent preferred embodiments of the invention. The following dependent claims represent particularly preferred embodiments of the invention.

We claim:

1. Device, for affixing to a golf bag, comprising:

(a) a rigid, flat, longitudinal side strip of a length not substantially exceeding the length of the golf bag and having an upper end and a lower end, the ends being designated in relation to the upper and lower ends of the golf bag;

(b) a rigid grip handle adapted at one end to receive a pin extending through an aperture in the upper end of the side strip, said pin firmly positioning the grip handle against the side strip;

(c) a rigid press step having a plurality of surfaces forming the top, bottom, front, back and sides of the press step, having substantially the same width as the side strip, having a top to bottom longitudinally extending aperture and a second aperture extending from the front of the press step at a right angle to and intersecting the longitudinal aperture, and adapted to receive a plurality of pins extending through a plurality of apertures in the lower end of the side strip, said pins firmly positioning the press step, at the back, against the side strip, the top of the press step being suitably adapted for being contacted with the bottom of a golfer's shoe;

(d) a rigid holding rod slidably housed in the longitudinal aperture in the press step and pointably adapted at one end for easy penetration into the ground;

(e) a pin movably housed in the second aperture of the press step and adapted to fixedly engage the holding rod;

(f) means for affixing the lower end of the side strip to the golf bag; and (g) a stop pin at the upper end of the side strip to prevent upward loss of the holding rod from the longitudinal aperture in the press step.

2. Device of claim 1 wherein the pins of (b), (c) and (e) are threaded pins.

3. Device of claim 2 wherein the pins of (c) are screws which are countersunk in the side strip from the side which is affixably adjacent the golf bag.

4. Device of claim 2 wherein the pin of (e) is a lock wing screw.

5. Device of claim 1 wherein the holding rod includes a suitably positioned notch to facilitate fixation of the rod by the pin of (e).

6. Device of claim 1 wherein the holding rod is adapted at the non-pointed end so as to have a dimension greater than the diameter of the longitudinal aperture of the press step to prevent downward loss of the holding rod from the longitudinal aperture.

7. Device of claim 1 wherein the grip handle has a knurled section on the end opposite to that which is adapted to receive the pin.

8. Device of claim 1 wherein said means of (f) is a flexible band or strap.

9. Golf bag having affixed thereto the device of claim 1.

10. Golf bag of claim 9 which includes, on the inside, near or at the bottom, a rigid or semi-rigid expansion band which provides support for said means of (f).

* * * * *